US009656367B2

(12) United States Patent
Xiong et al.

(10) Patent No.: US 9,656,367 B2
(45) Date of Patent: May 23, 2017

(54) UNIVERSAL CARRIER DEVICE AND ADAPTIVE COMPONENTS FOR THE CARRIER DEVICE

(71) Applicant: Seagate Technology LLC, Cupertino, CA (US)

(72) Inventors: Yuhong Xiong, Maple Grove, MN (US); Marc Ronshaugen, Eden Prairie, MN (US); Joel Hoehn, Hudson, WI (US); Kevin Mayer, Apple Valley, MN (US); Paul Gallup, Plymouth, MN (US); Gordon Jones, Faribault, MN (US)

(73) Assignee: Seagate Technology LLC, Cupertino, CA (US)

( * ) Notice: Subject to any disclaimer, the term of this patent is extended or adjusted under 35 U.S.C. 154(b) by 63 days.

(21) Appl. No.: 14/508,306

(22) Filed: Oct. 7, 2014

(65) Prior Publication Data

US 2015/0099438 A1 Apr. 9, 2015

Related U.S. Application Data

(60) Provisional application No. 61/887,586, filed on Oct. 7, 2013.

(51) Int. Cl.

| | |
|---|---|
| ***B24B 41/06*** | (2012.01) |
| ***B24B 37/30*** | (2012.01) |
| ***B24B 37/04*** | (2012.01) |

(52) U.S. Cl.
CPC ..... *B24B 37/30* (2013.01); *B24B 37/048* (2013.01)

(58) Field of Classification Search
USPC ..... 451/259, 278, 279, 364
See application file for complete search history.

(56) References Cited

U.S. PATENT DOCUMENTS

| | | | | |
|---|---|---|---|---|
| 6,346,029 | B1 * | 2/2002 | Church | B24B 37/048 451/11 |
| 2001/0049251 | A1 * | 12/2001 | Anderson | B24B 37/048 451/5 |
| 2005/0006227 | A1 * | 1/2005 | Hao | G11B 5/5552 204/192.34 |

* cited by examiner

*Primary Examiner* — Joseph J Hail
*Assistant Examiner* — Shantese McDonald
(74) *Attorney, Agent, or Firm* — Westman, Champlin & Koehler, P.A.

(57) ABSTRACT

An assembly includes a carrier device having proximal and distal ends. The carrier device includes a workpiece platform along the proximal end. The workpiece platform supports one or more slider bars. The carrier device attaches to a lapping machine. An adaptive component, including at least one spring, has a first portion that couples to the carrier device and a second portion that couples to a grinding-slicing machine.

14 Claims, 14 Drawing Sheets

UNIVERSAL CARRIER DEVICE AND ADAPTIVE COMPONENTS FOR THE CARRIER DEVICE

CROSS-REFERENCE TO RELATED APPLICATIONS

The present application is based on and claims the benefit of U.S. provisional patent application Ser. No. 61/887,586, filed Oct. 7, 2013, the content of which is hereby incorporated by reference in its entirety.

BACKGROUND

Data storage systems commonly have a recording head that includes a read transducer that reads information from a data storage medium and a write transducer that writes information to a data storage medium. Usually, the recording head is integrally mounted in a carrier or support referred to as a "slider." In manufacturing such recording heads, a large number of sliders are fabricated from a single wafer having rows of heads deposited on the wafer surface using semiconductor-type process methods. In one process embodiment, after the deposition of the heads is complete, slicing, grinding and lapping operations are typically carried out to produce individual sliders from the wafer.

SUMMARY

The present disclosure relates to a carrier device used to help secure one or more slider bars to a lapping machine and a grinding-slicing machine and one or more adaptive components for the carrier device.

In one assembly embodiment, a carrier device having a low profile structure is configured to secure one or more slider bars to a grinding-slicing machine or a lapping machine. The carrier device has a thickness of about 2 to 3 millimeters.

In another assembly embodiment, a carrier device is configured to secure one or more slider bars to a lapping machine. The carrier device includes multiple bending strips extending from a proximal end of the carrier device to a bending tip proximate to a distal end of the carrier device. The bending tip includes multiple bending fingers. A holder plate is configured to couple to the bending tip of the carrier device and also configured to couple to a grinding-slicing machine.

In yet another assembly embodiment, a carrier device includes proximal and distal ends, with a workpiece platform along the proximal end. The workpiece platform supports one or more slider bars. The carrier device attaches to a lapping machine. The assembly also includes an adaptive component that has at least one spring. The adaptive component has a first portion that couples to the carrier device and a second portion that couples to a grinding-slicing machine.

These and other features and aspects of various embodiments may be understood in view of the following detailed discussion and accompanying drawings.

DETAILED DESCRIPTION OF ILLUSTRATIVE EMBODIMENTS

Figure 1:
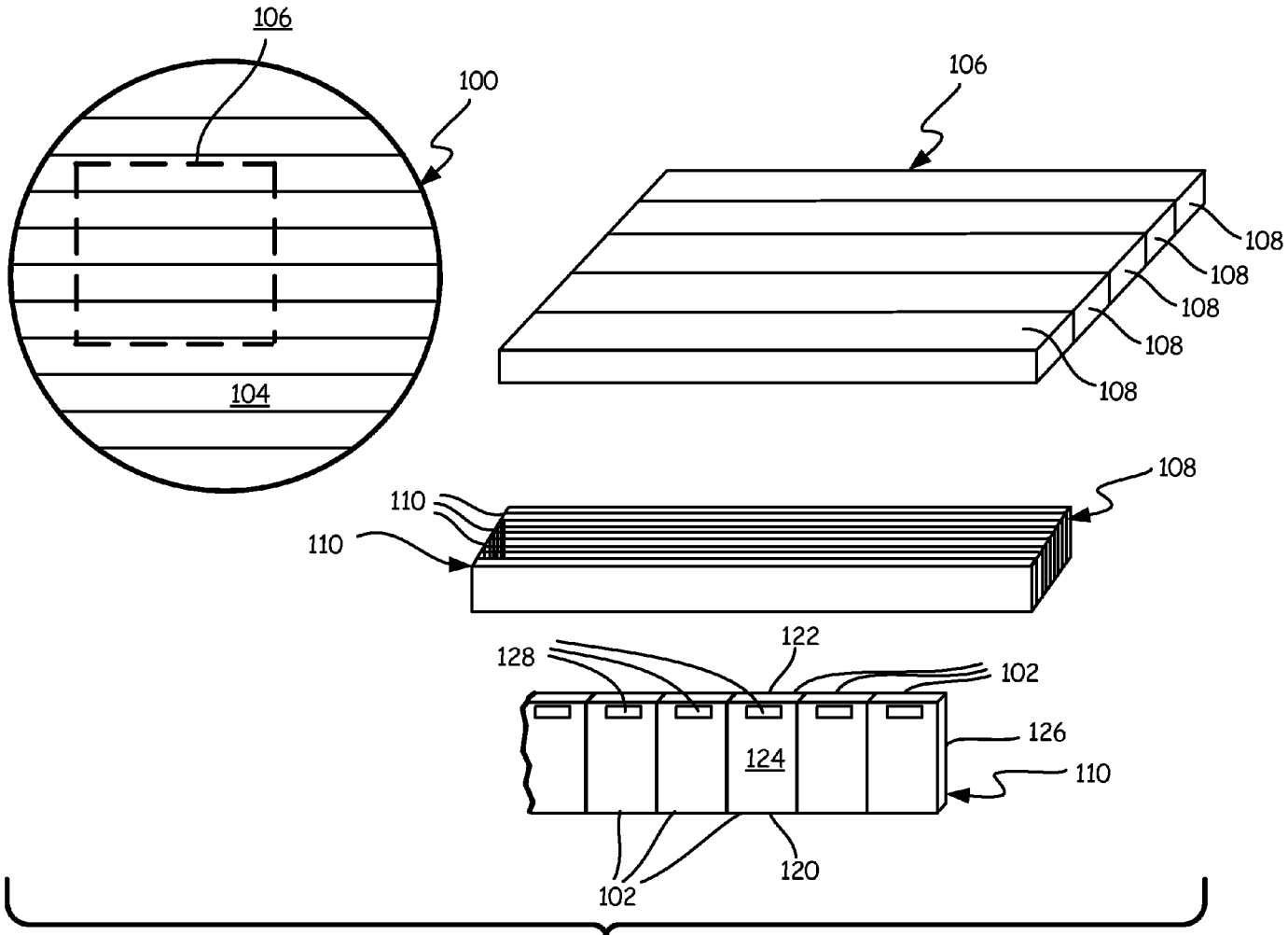
FIG. 1 illustrates a slider bar chunk and bar stack fabricated from a wafer using thin film deposition techniques and a slider bar and head sliced from the slider bar stack.

Grinding and lapping process steps are used to fabricate heads or other components that require tight tolerance control. FIG. 1 illustrates a wafer 100 for fabricating multiple heads 102 or sliders for data storage devices. An array of transducer elements is deposited or formed on a front surface 104 of the wafer 100 using known thin film deposition techniques to form read and/or write elements of the heads 102. Following deposition of the transducer elements, the wafer 100 is cut into slider bar stacks or chunks 106 including multiple slider bars stacks 108. The slider bar chunk 106 is sliced into the slider bar stacks 108. Slider bar stacks 108 include multiple slider bars 110 which are sliced from the slider stacks 108. The slider bar chunk may include, for example, 45 bars 110 and the slider bar stack may include, for example, 9 slider bars 110. However, any suitable number of bars may be included in a stack and the examples provided are not meant to be limiting. Bars 110 are sliced from the stack and the heads 102 are sliced from the bars 110. As shown, the slider bars 110 include a leading edge 120, a trailing edge 122, primary surface 124 and a back surface 126. As shown, the deposited thin film layers on the front surface 104 of the wafer 100 form the one or more transducer elements 128 along the primary surface 124 of the slider bar 110 or head 102. During the fabrication process, bars 110 are subjected to grinding and lapping steps to control dimensional parameters, thickness and bow of the bar 110. The primary surface 124 of the bar 110 is ground and/or lapped during the fabrication process to enhance flatness and perpendicular alignment of the primary surface of the slider or head 102.

Figure 2:
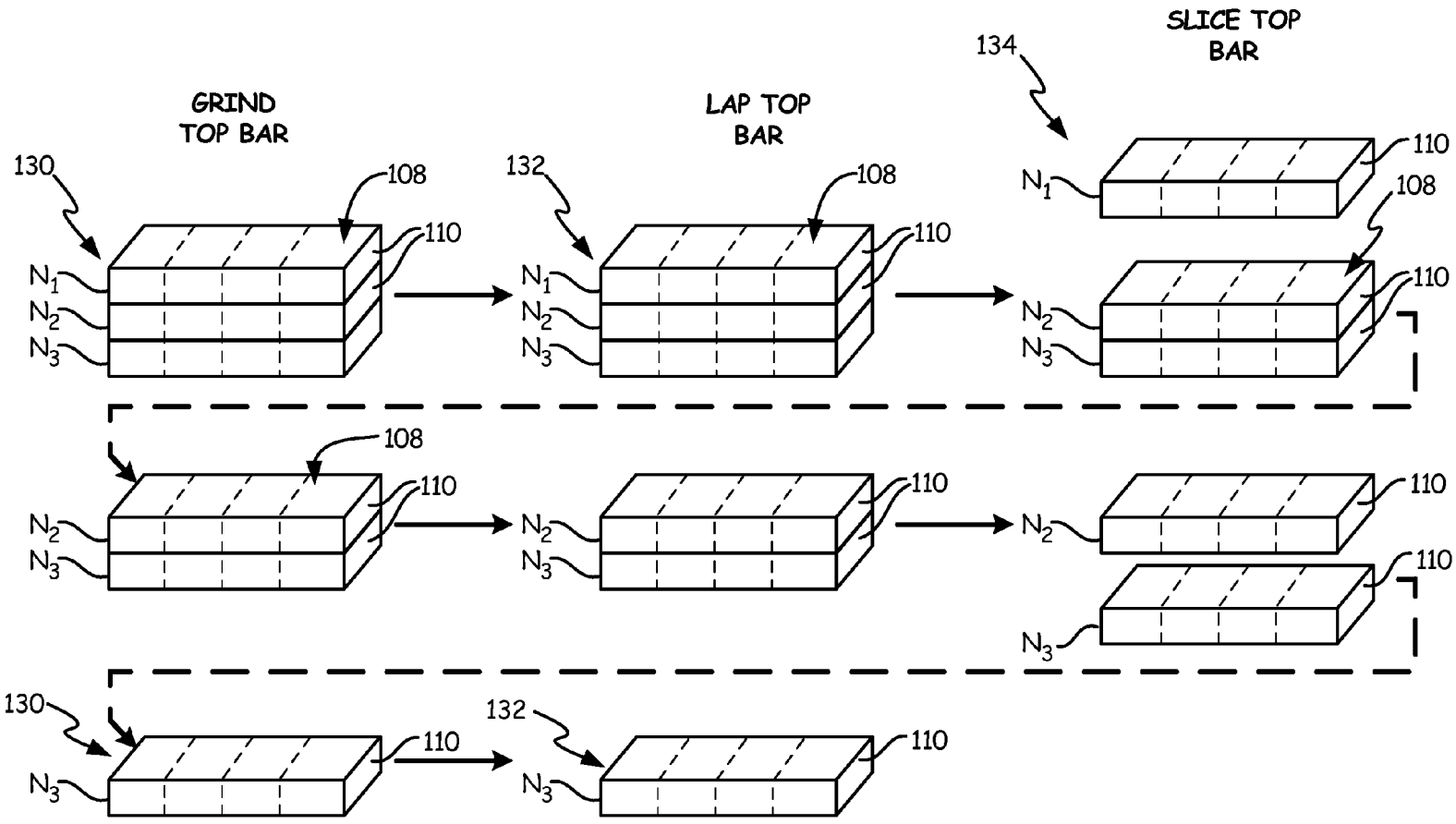
FIG. 2 illustrates an embodiment of a processing sequence for grinding-lapping-slicing slider bars to form heads.

FIG. 2 illustrates an embodiment of a process sequence for grinding, lapping and slicing slider bars 110 or a slider bar stack 108 including slider bars $N_1$-$N_3$. It should be noted that although 3 slider bars ($N_1$-$N_3$) are shown in FIG. 2, the slider bar stack in the embodiment of FIG. 2 may include up to 10 or even 15 slider bars, for example. In the process sequence shown, the top bar $N_1$ of the stack 108 is sequentially ground in step 130, lapped in step 132 and sliced from the stack 108 in step 134. In particular, the surface of top bar $N_1$ is ground in step 130 and lapped in step 132. Following the grinding and lapping in steps 130, 132, the top bar $N_1$ is sliced from the stack 108 so that bar $N_2$ becomes the top bar. The process of grinding-lapping-slicing of steps 130, 132, 134 is then repeated for top bar $N_2$ so that following step 134, bar $N_3$ is the top bar 110. The process steps of grinding and lapping 130, 132 the top surface is repeated for top bar $N_3$. The process sequence illustrated in steps 130, 132 and 134 is repeated until each bar in the stack 108 is ground and lapped and then separated from the stack 108.

A grinding-slicing machine is used to grind and slice the bars in steps 130, 134 and a lapping machine is used to lap the bars 110 in step 132. For the lapping step 132, the one or more slider bars 110 are attached to a lapping carrier including multiple bending inputs to control slider bar 110 bow. If the lapping carrier is not configured to be mounted on a gliding-slicing machine for grinding and slicing operations, the one or more slider bars will have to be demounted from such a lapping carrier and connected to a grinding-slicing machine for example, through an extender that is designed for mounting to the grinding-slicing machine. Demounting the one or more slider bars 110 from the carrier device for the slicing and grinding steps 130, 134 and remounting the one or more slider bars 110 to the carrier device for lapping increases processing steps and cost.

Figure 3A:
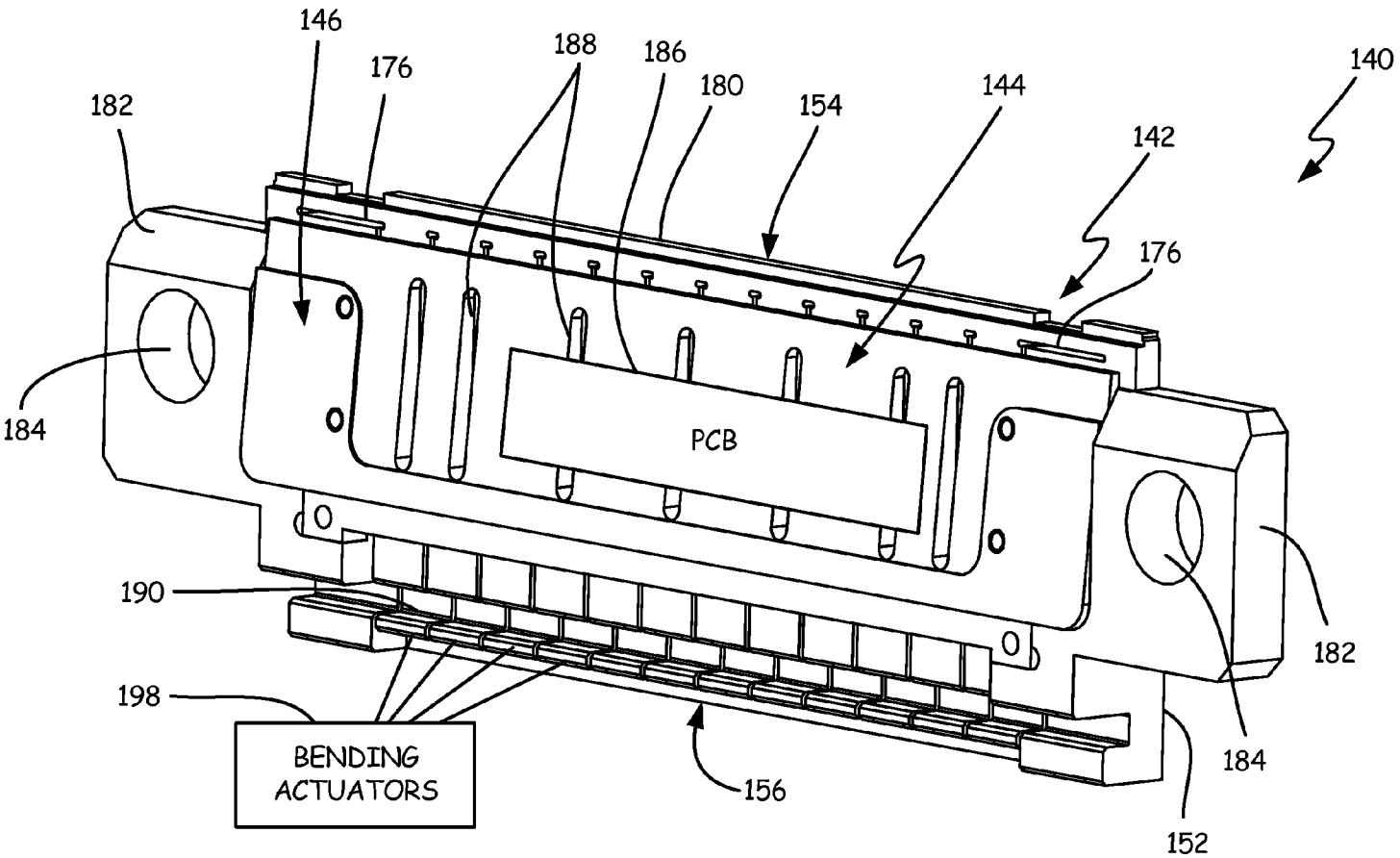
FIGS. 3A-3B illustrate an embodiment of a universal carrier device for supporting one or more slider bars for one or more of the processing steps illustrated in FIG. 2.
Figure 3B:
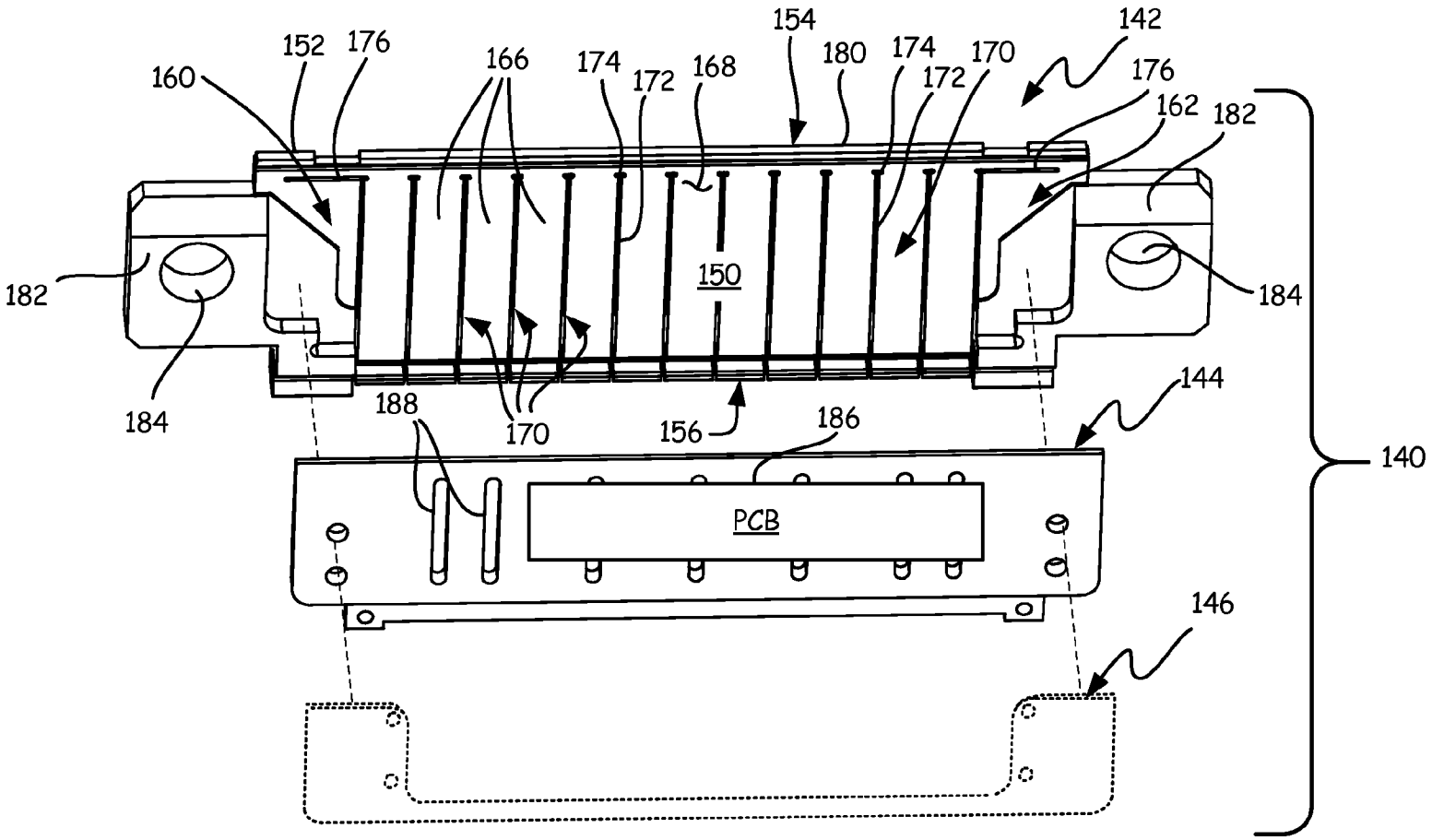
Figure 3C:
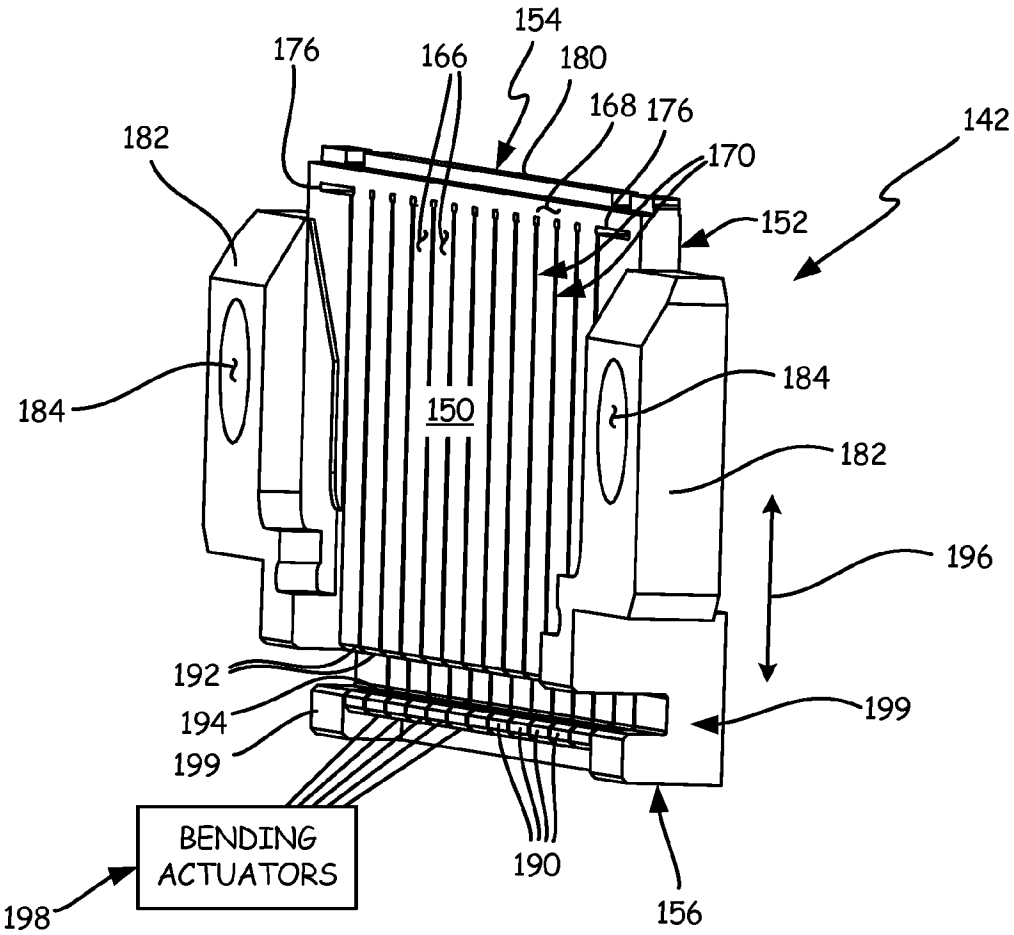
FIG. 3C is a detailed illustration of a bending plate of the carrier device including input bending fingers for inputting force or bending to one or more bending strips of the carrier device.

FIGS. 3A-3C illustrates an embodiment of a universal carrier device 140 for connecting the bar stack 108 or bar 110 (not shown) to multiple processing machines including the lapping machine and the grinding-slicing machine. In certain embodiments, the carrier device 140 has a low profile and is connected to the lapping and grinding-slicing machines through one or more adaptive components. In the embodiment shown, the carrier device 140 is formed of a multiple plate structure including a bending plate 142, an electrical connector plate 144 and a cover plate 146. The bending plate 142, connector plate 144 and cover plate 146 are shown separately exploded in FIG. 3B. Some embodiments may not utilize cover plate 146. To indicate that cover place 146 is optional, a dashed line is used for that element in FIG. 3B.

As shown, the bending plate 142 forms a base structure having a front surface 150, a back surface 152 (not shown in FIG. 3C), proximal end 154, a distal end 156 and opposed end portions 160, 162. The bending plate 142 includes a low profile thickness dimension between the front and back surfaces 150, 152 to adapt the carrier device 140 for different applications. The structure of the bending plate 142 includes a plurality of bending strips 166 extending from a connective portion 168 at the proximal end 154 of the bending plate 142. The bending strips 166 as shown are spaced between opposed end portions 160, 162 of the base structure. The bending strips 166 are separated by gaps 170 having a longitudinal gap portion 172 and a narrow crosswise gap portion 174 at a juncture of the bending strips 166 and the connective portion 168 at the proximal end 154 of the base structure. As shown, the end portions 160, 162 include a crosswise gap 176 extending from an outer bending strip 166 along the end portions 160, 162 of the bending plate 142. As shown, a workpiece platform 180 is formed along a proximal end of the bending plate 142 to support a workpiece (or illustratively the one or more slider bars 110). As shown, the bending plate 142 includes attachment extensions 182. The attachment extensions 182 include fastener openings 184 to connect the carrier device 140 to one or more processing machines such as the lapping machine (not shown).

Figure 6A:
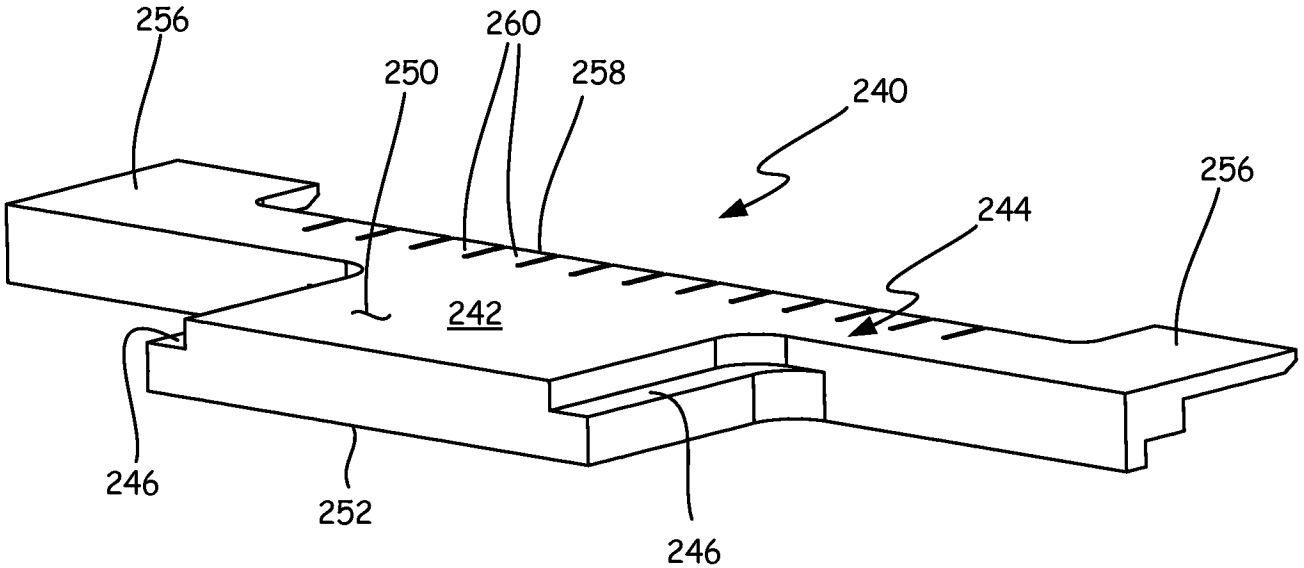
FIGS. 6A-6C illustrate an embodiment of an adaptive component for connecting the carrier device to the grinding-slicing machine for grinding and slicing the one or more slider bars connected to the carrier device.
Figure 6B:
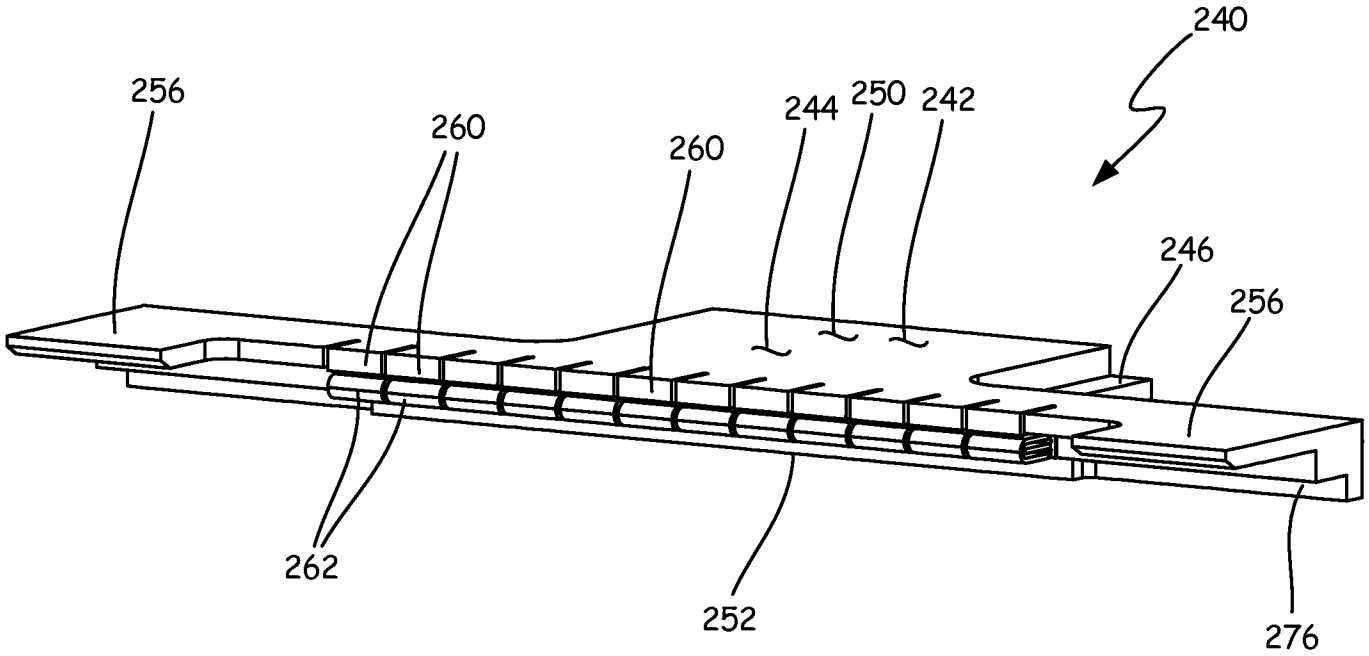
Figure 6C:
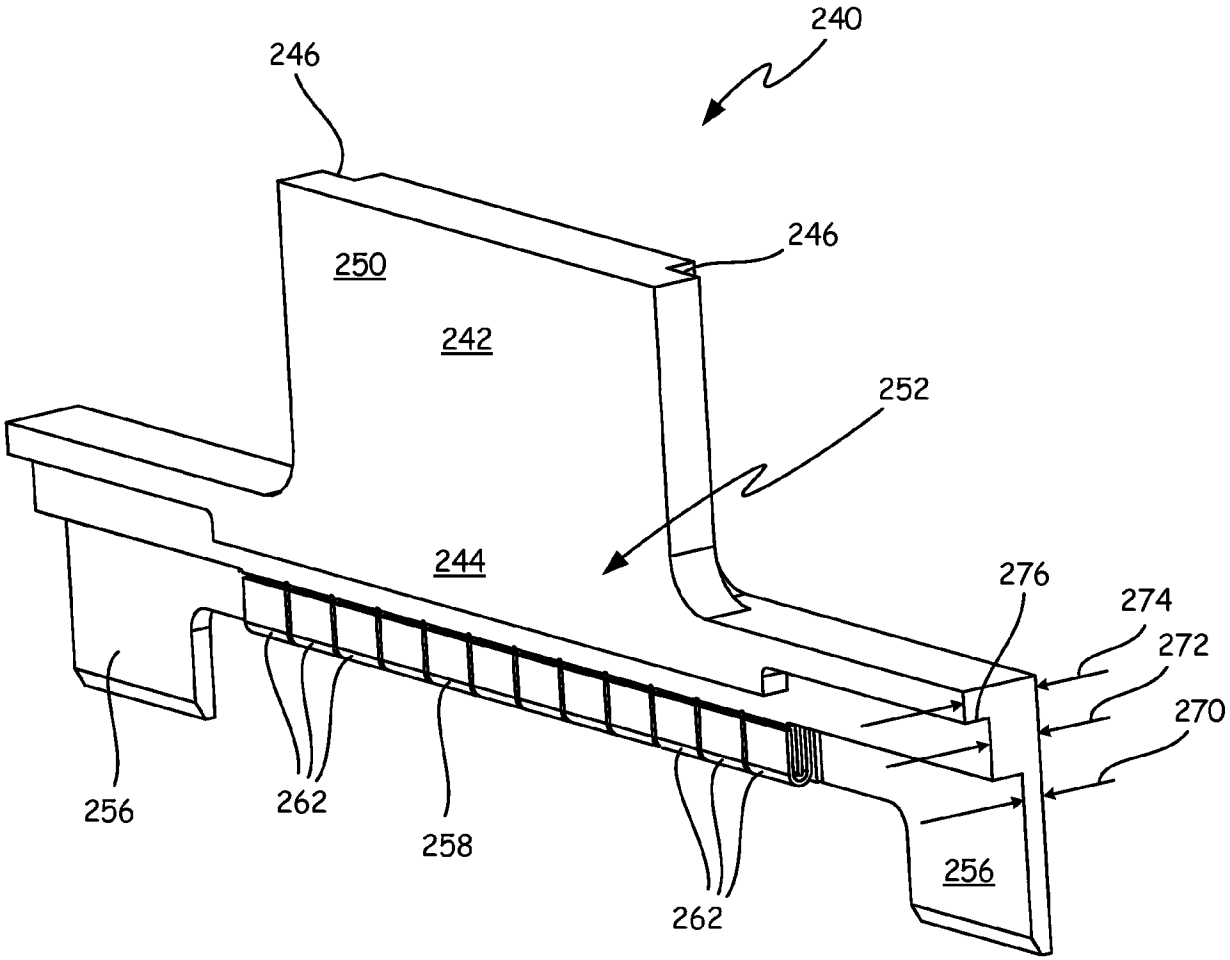
Figure 6D:
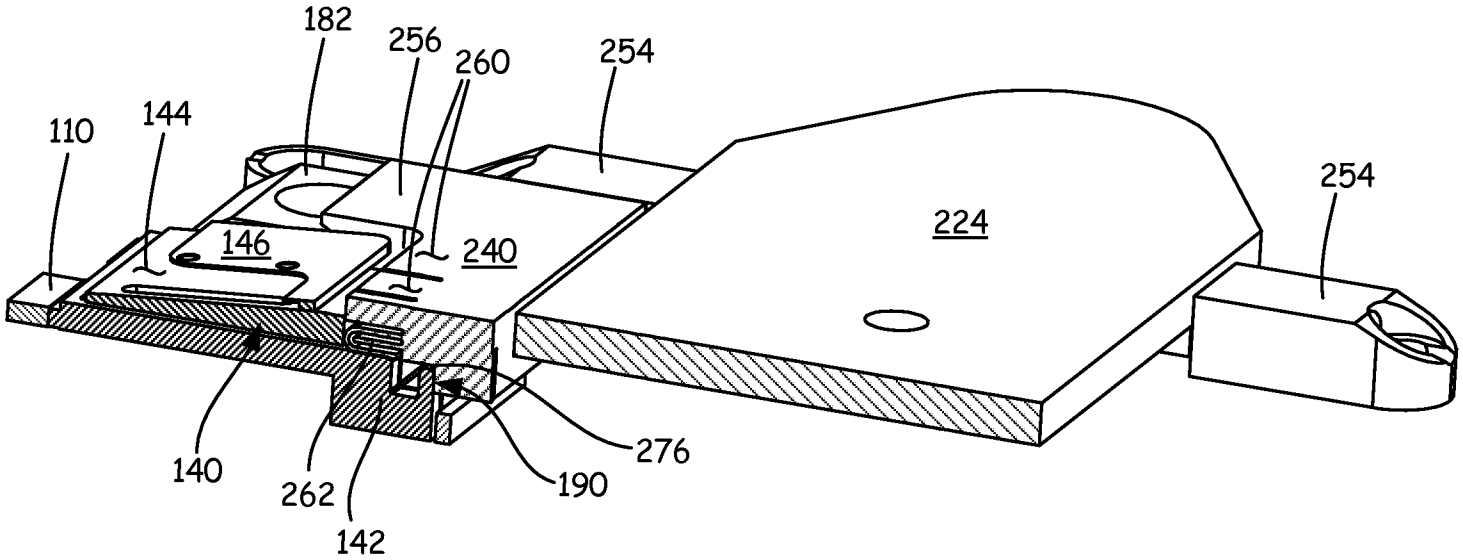
FIG. 6D is a cross-sectional view of a clamp, holder plate and carrier device for the grinding-slicing machine illustrated in FIGS. 5A-5C.

As schematically shown in FIG. 3B, the connector plate 144 is used to support electrical connector elements or printed circuit board (PCB) 186 illustrated in phantom. The connector elements or PCB 186 is secured to the connector plate 144 through the cover plate 146. The electrical connector elements or PCB 186 provides an interface for feedback from electronic lapping guides on the slider bar 110 to control bending input to the bending strips 166, to control slider bow and other parameters during the lapping process. The connector plate 144 connects to the end portions 160, 162 of the bending plate 142. In the embodiment shown, the connector plate 144 includes a plurality of lengthwise slots 188 to facilitate cleaning. In some embodiments, the connector plate 144 is coupled to the bending plate 142 using any suitable type of fastener (for example, screws). Also, the cover plate 146 is coupled to the connector plate 144 using a suitable fastener to secure the connector elements or PCB 186 to the connector plate 144. It should be noted that, instead of using fasteners, other techniques such as spot welding may be used to couple different components together. In one embodiment, the connector plate 144 includes a sloped front surface as shown in FIG. 6D. Illustratively, the sloped surface has approximately a 5 degree slope.

FIG. 3C illustrates a side view of the bending plate 142. As shown, the bending strips 166 have a cantilevered length that extends from the connective portion 168 at the proximal end 154 to a bending tip proximate to the distal end 156 of the bending plate 142. The bending tips as shown includes generally "u" shaped bending fingers 190. The bending fingers 190 form bi-directional bending contacts or surfaces 192, 194 to input longitudinal push or pull forces to the bending strips 166 as illustrated by arrow 196. As shown schematically, one or more bending actuators 198 are coupled to the bending fingers 190 to input the push/pull force to the bending strips 166 through the input bending fingers 190 during the lapping process step. Illustratively, the bending actuators are bi-directional actuators 198 (e.g. pneumatic actuators) to input the push/pull force to adjust bow for lapping. As shown, the bending plate 142 includes guard portions 199 on opposed sides of the bending fingers 190 to protect the bending fingers 190 from damage or misalignment due to extraneous force or contact.

In different embodiments, the bending strips 166 have a generally elongate length and relatively flat thickness to form the low profile carrier device. In some embodiments, the thickness of the low profile carrier device 140 is approximately 2-3 millimeters—mm. However, in some embodiments, the thickness of the carrier device 140 may be substantially greater than 2-3 mm. In the embodiment shown, the carrier device 140 includes twelve (12) bending strips 166 although the application is not limited to the particular embodiment shown.

Figure 4A:
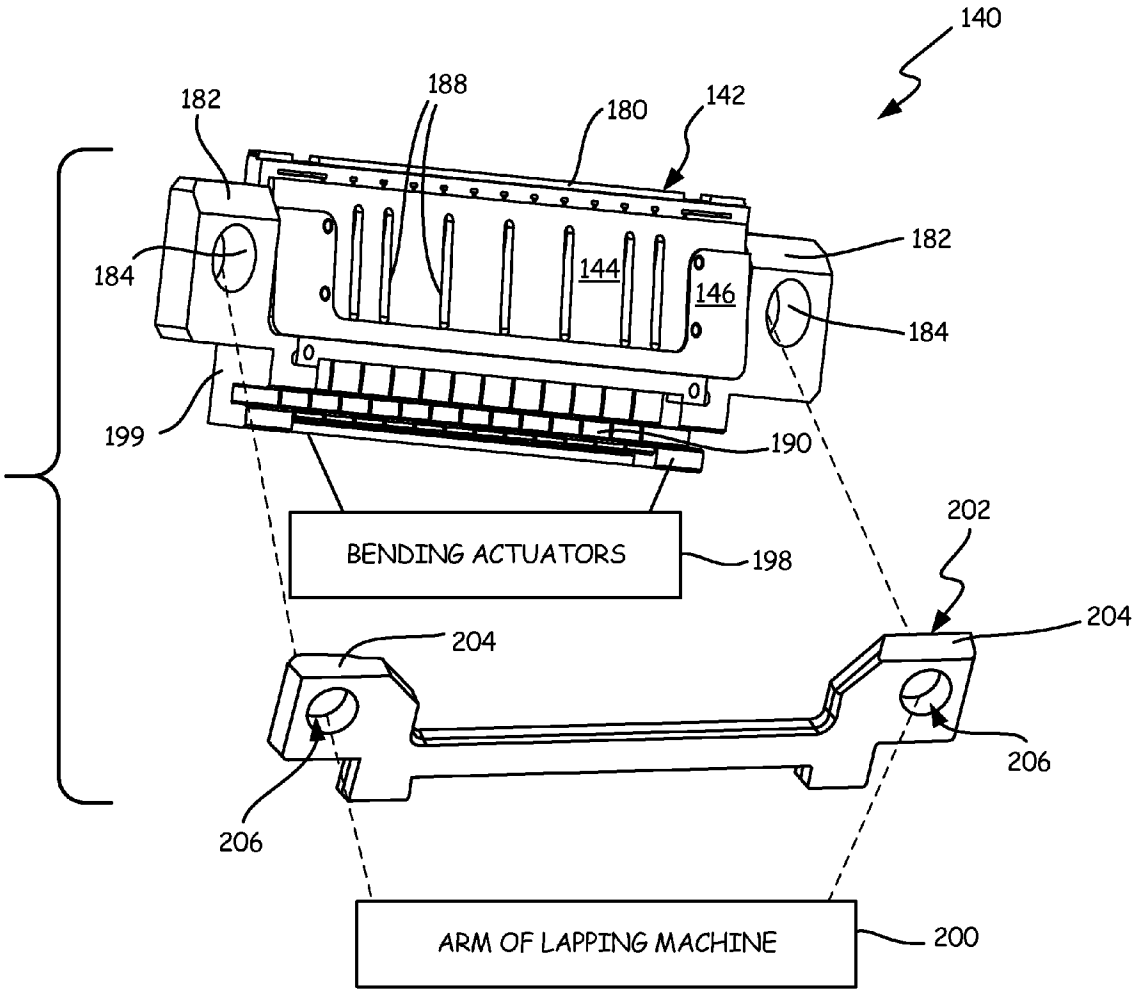
FIGS. 4A-4B illustrate an embodiment of the carrier device and adaptive component for connecting the carrier device to a lapping arm of a lapping machine.
Figure 4B:
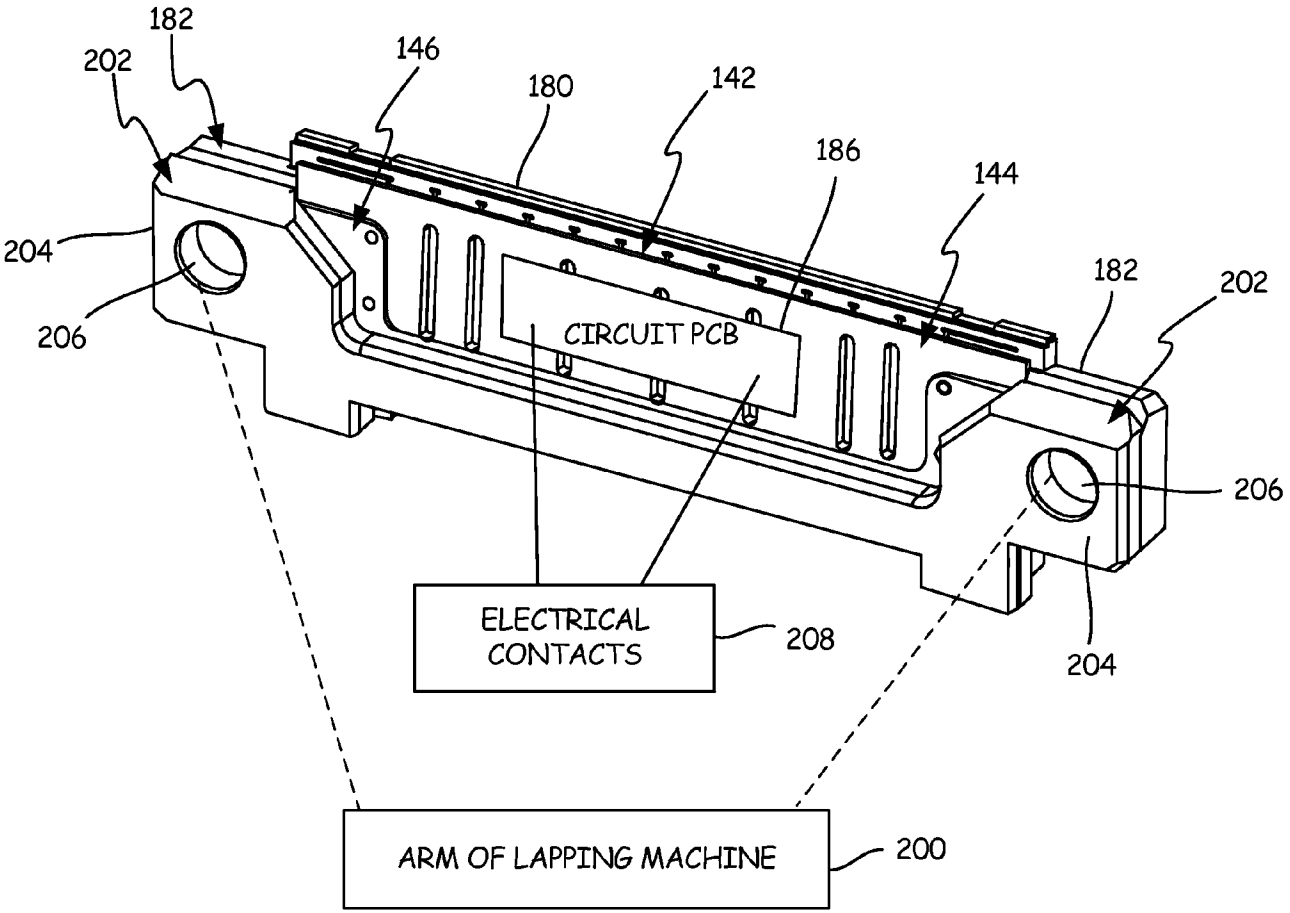

In an illustrative embodiment, the carrier device 140 as shown in FIGS. 3A-3B is secured to different processing machines using one or more adaptive components. As shown in FIGS. 4A-4B, for the lapping process step 132, one or more bars 110 (not shown in FIGS. 4A and 4B) are coupled to the workpiece platform 180 of the carrier device 140 and the carrier device 140 is attached to an arm of a lapping machine 200 (illustrated schematically) through the fastener openings 184 in the attachment extensions 182. In the embodiment shown, the carrier device 140 is connected to the lapping arm 200 through a spacer plate 202 which adapts the low profile carrier device 140 for use with a standard profile lapping machine. As shown, the spacer plate 202 includes spacer extensions 204 having fastener opening 206 which align with the fastener opening 184 on the bending plate 142 of the carrier device 140 to secure the carrier device 140 to the lapping machine.

In embodiments in which the carrier device 140 is 2-3 mm thick, a thickness of the spacer plate 202 compensates for the thin profile dimension of the carrier device 140 to provide a combined thickness for the attachment extensions 182 and spacer extensions 204 on the spacer plate 202, which is sufficient to adapt the low profile carrier device 140 for use with a standard lapping machine. As shown in FIG. 4B, for operation, electrical contacts or pogo pins illustrated schematically at 208 interface with contacts or terminals of the electrical connector elements or PCB 186 mounted on the connector plate 144 of the carrier device 140 to provide feedback to control the bending input to the bending strips 166. In embodiments in which the thickness of the carrier device 140 is substantially greater that 2-3 mm, no spacer may be needed for connecting the relatively thick carrier device 140 to the standard lapping machine.

Figure 5A:
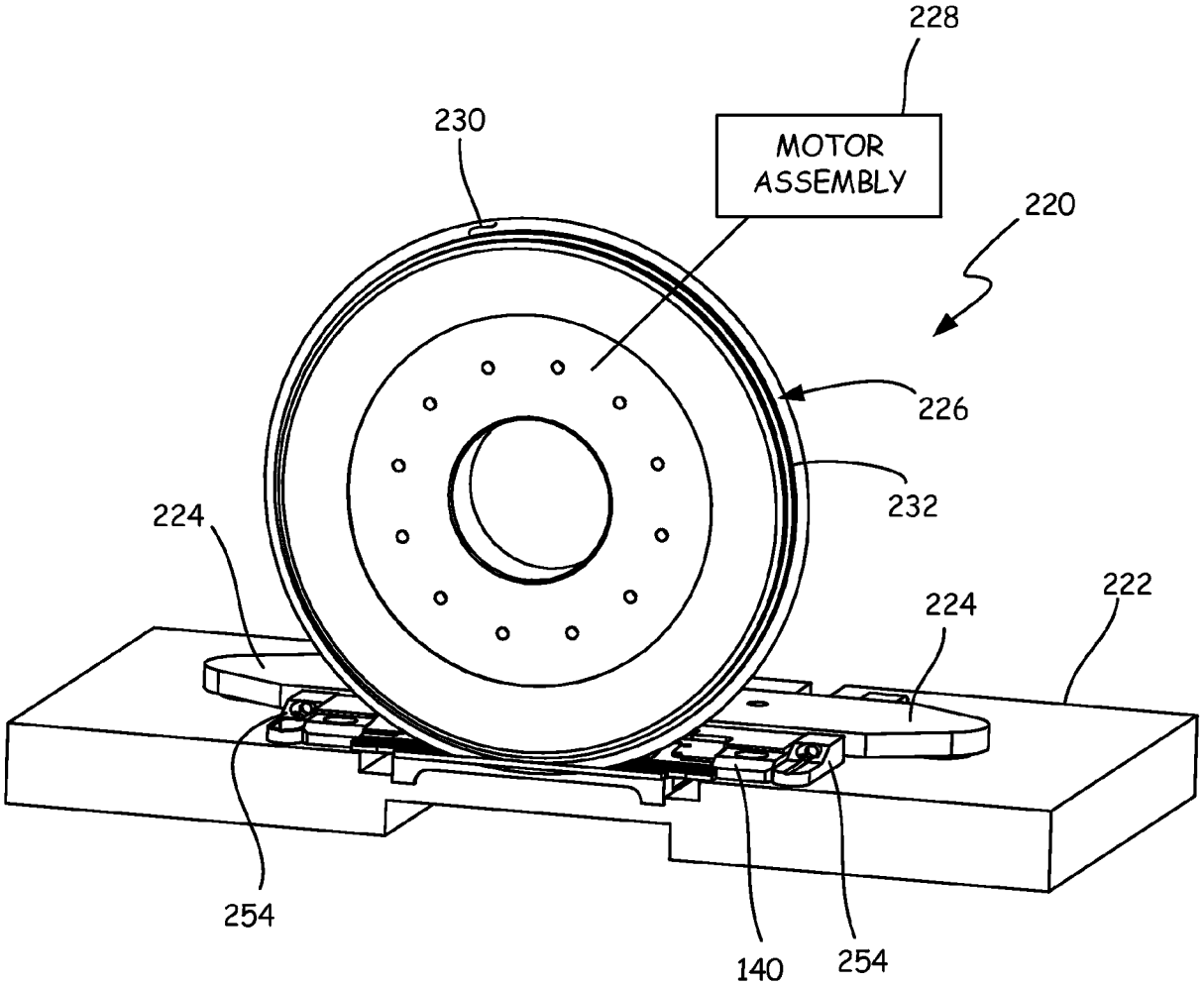
FIGS. 5A-5B illustrate an embodiment of a grinding-slicing machine for grinding and slicing one or more slider bars connected to the universal carrier device.
Figure 5B:
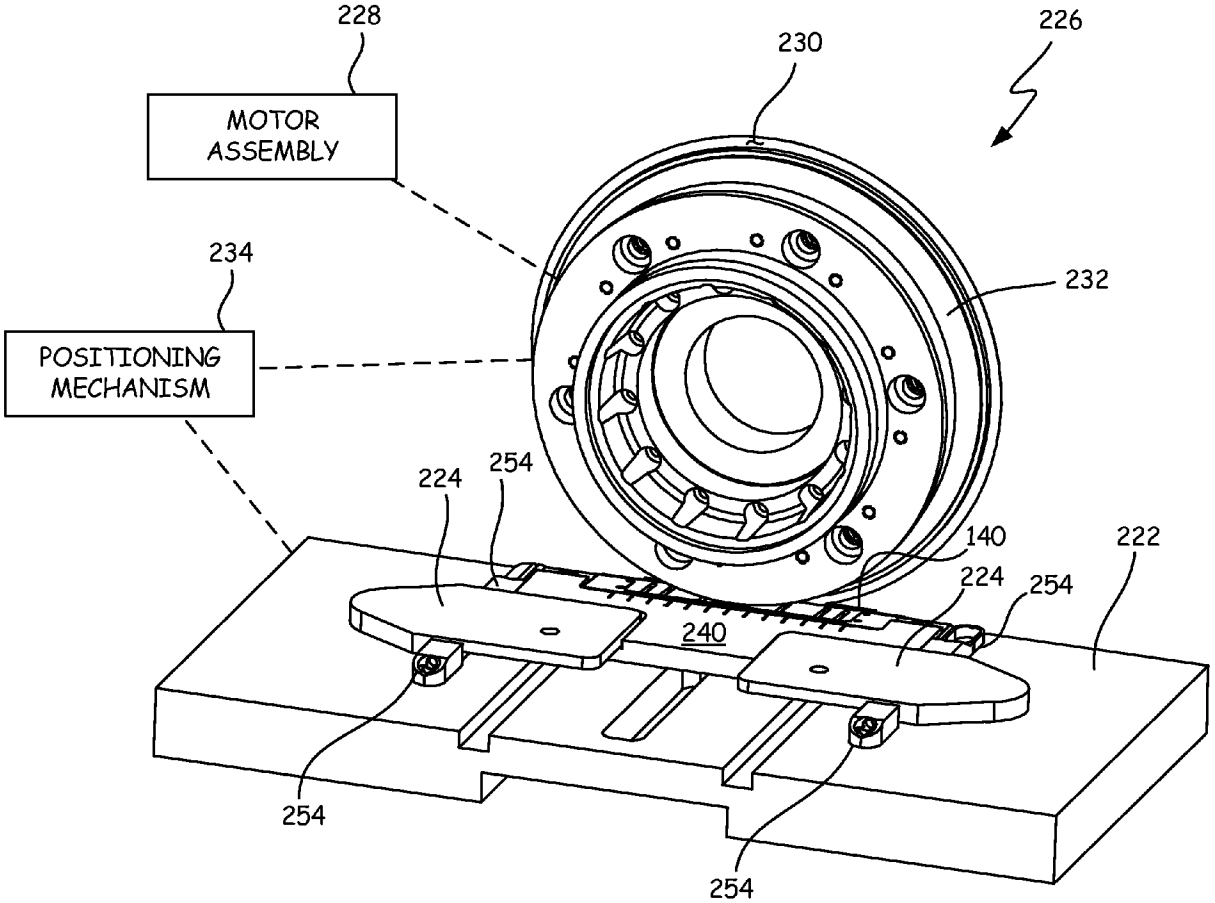

FIGS. 5A-5B illustrate a grinding-slicing machine 220 adapted to support the low profile carrier device 140 to grind and slice the one or more slider bars 110 coupled to the platform 180 of the carrier device 140. The carrier device 140 is supported on a stage 222 of the grinding-slicing machine 220 and clamped to the stage 222 via clamps 224 through one or more adaptive components. As shown, the grinding-slicing machine 220 includes a grinding/slicing wheel 226 operated through a motor assembly 228. As shown, the grinding/slicing wheel 226 includes a circular blade 230 to slice slider bars 110 from the slider bar stack 108 and abrasive drum 232 for grinding. As shown, the wheel 226 is rotated via the motor assembly or components 228 as schematically shown to slice and grind the one or more bars 110. The blade 230 and drum 232 are positioned relative to the one or more slider bars 110 via a positioning mechanism 234 illustrated schematically in FIG. 5B. As shown, the positioning mechanism 234 can move the wheel 226 (blade 230 and drum 232) relative to the stage 222 or move the stage 222 relative to the wheel 226 to position the blade 230 and drum 232 relative to the one or more slider bars 110 for grinding and slicing operations.

In FIGS. 5A-5B, the carrier device 140 is secured to the stage 222 of the grinding-slicing machine through holder plate 240 which forms the adaptive component for attaching the carrier device 140 to the grinding-slicing machine as shown in FIG. 5B. FIGS. 6A-6B illustrate an embodiment of the holder plate 240. As shown, the holder plate 240 includes a clamp portion 242 and a carrier portion 244. The clamp portion 242 of the holder plate 240 includes a stepped surface 246 along a perimeter edge between a front surface 250 of the holder plate and a back surface 252 of the holder plate 240. The clamps 224 of the grinding-slicing machine 220 engage the stepped surface 246 of the holder plate 240 to clamp the holder plate 240 to the stage 222. In the embodiment illustrated in FIGS. 5A-5B, clamps 224 are pivotally connected to the stage 222 through pivot blocks 254. Clamps 224 are rotationally supported by the pivot blocks 254 and rotate between an opened position and a clamped position shown to engage the stepped surface 246 of the holder plate 240.

As shown, the carrier portion 244 of the holder plate 240 includes holder extensions 256 that extend from opposed sides of the holder plate 240 to form a recessed surface 258 along a front of the holder plate 240. As shown, the carrier portion 244 includes a plurality of holder fingers 260 spaced along the recessed surface 258 and plurality of spring elements 262 along the back surface 252 of the holder plate 240 underneath the holder fingers 260 as seen in FIGS. 6B-6C. For attachment, the holder extensions 256 are aligned as shown in FIG. 6D to abut the attachment extensions 182 of the bending plate 142 of the carrier device 140. Thus as shown, the carrier device 140 is cooperatively secured to the stage 222 through engagement of the holder extensions 256 of the holder plate 240 with the attachment extension 182 on the carrier device 140, which is secured to the stage 222 through clamps 224.

As shown, the carrier portion 244 of the holder plate 240 includes multiple thickness tiers 270, 272, 274 as shown in FIG. 6C to conform to the shape of the carrier device 140. The first thickness portion 270 is along the holder extensions 256 and recessed surface 258. As shown, springs 262 are formed along the recessed surface 258 along the first thickness portion 270 and are flush with the second thickness portion. As shown in FIG. 6D, the springs 262 to press against the bending strips 166 to apply pressure to the bending strips 166 and fingers 190 to limit movement or displacement during the grinding and slicing process steps.

Figure 5C:
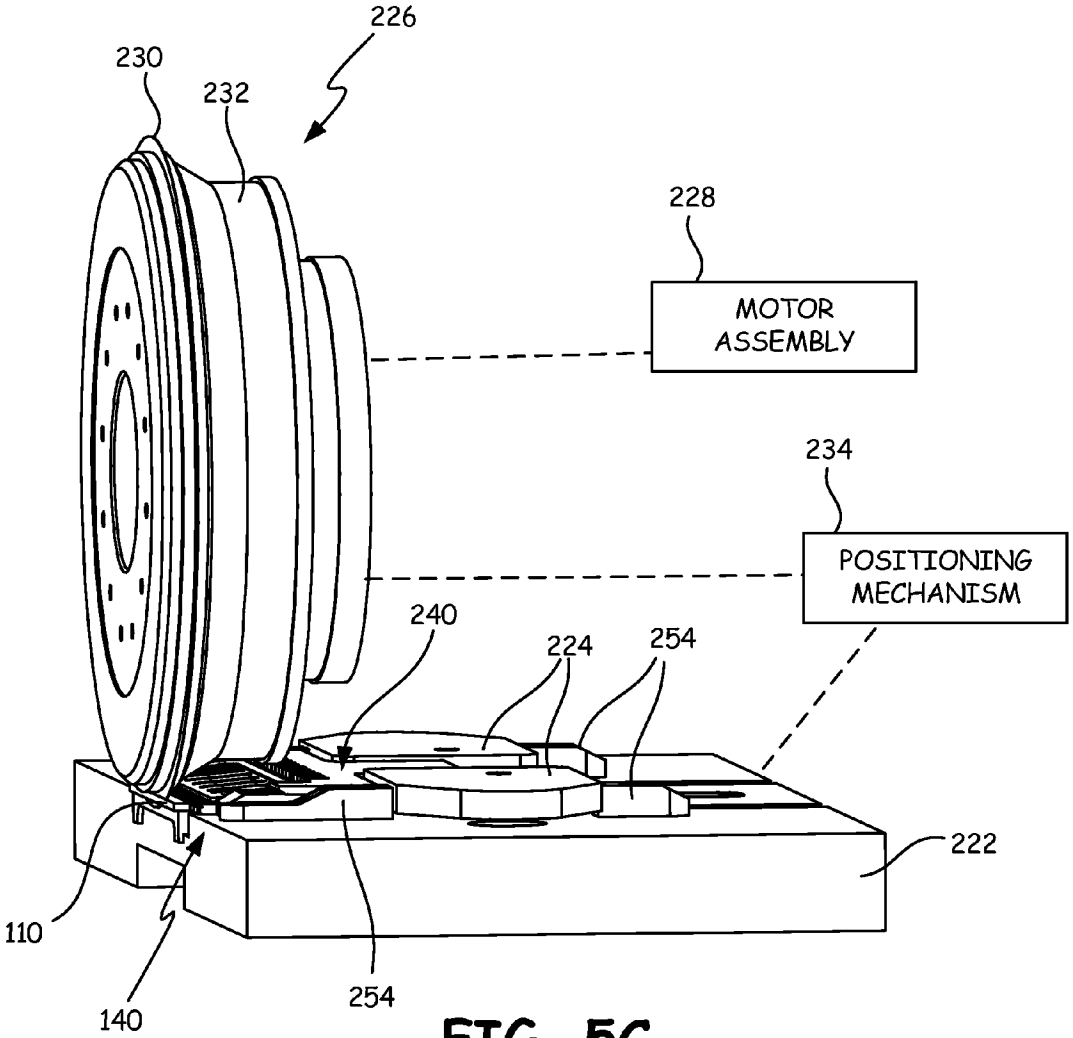
FIG. 5C is a side view of the grinding-slicing machine illustrated in FIGS. 5A-5B.

A back step 276 is formed between the second and third thickness portions 272, 274 as shown in FIG. 6C. The back step 276 forms a back edge surface that abuts the bending fingers 190 of the carrier device 140 to limit backward or distal movement of the fingers 190 during the grinding and slicing processing steps as illustrated in FIG. 6D. As shown, the bending fingers 190 are exposed to interface with the springs 262 and the back step 276 during the grinding and slicing processing steps 130, 134. The back edge surface as shown forms a distal contact to limit movement of the fingers 190 of the carrier device 140. Thus, as described, springs 262 and back edge surface 276 retain the fingers 190 during the grinding and slicing operations to limit deformation of the fingers 190 during the grinding and slicing processing steps. In an embodiment, clamps 224 shown in FIGS. 5A-5C are pneumatically operated via a pneumatic actuator or vacuum device (not shown). In the closed position, the clamps 224 bias the carrier device 140 against the stage 222 through the holder plate 240.

Thus as described, the carrier device 140 disclosed is adapted for use for grinding, lapping and slicing processing steps through the use of one or more adaptive components to provide a universal carrier device. In some of the embodiments, the carrier device 140 is adapted for use on a lapping machine through the spacer plate 202 and adapted for use on a grinding-slicing machine 220 through the holder plate 240. As indicated above, in other embodiments, where the carrier device is greater than 2-3 mm thick, no spacer plate such as 202 may be used for connecting the carrier device 140 to the lapping machine. However, in such embodiments, a holder plate such as 240 is used to couple the carrier device 140 to a grinding-slicing machine. The universal carrier device 140 as described, reduces mounting and demounting processing steps to streamline fabrication of heads 102 or other miniature components requiring tight tolerance control. Although the machine illustrated in FIGS. 5A-5C includes both a blade 230 and abrasive drum 232, the slicing and grinding processing steps can be implemented using a separate grinding machine and slicing machine where the holder plate 240 is used to secure the carrier device 140 to the stage 222 of the separate machines.

In an illustrative embodiment, the bending, connector and cover plates 142, 144, 146 of the carrier device 140 are formed of a titanium-aluminum-vanadium Ti—Al—V alloy material to provide sufficient displacement to input bending to the one or more slider bars supported on the platform 180 while providing sufficient stiffness to compensate for input load and stress during the lapping, grinding and slicing processing steps. An illustrative titanium-aluminum-vanadium alloy material is Ti-6Al-4V. Although a particular material is disclosed, application is not limited to the particular material disclosed and other materials that provide sufficient displacement and stiffness for a low profile assembly can be used.

It is to be understood that even though numerous characteristics and advantages of various embodiments of the disclosure have been set forth in the foregoing description, together with details of the structure and function of various embodiments, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application while maintaining substantially the same functionality without departing from the scope and spirit of the present disclosure. In addition, although the preferred embodiment described herein is directed to a carrier device for lapping-grinding and slicing slider bars, it will be appreciated by those skilled in the art that the teachings of the present application can be applied to other processing machines or steps, without departing from the scope and spirit of the present disclosure.

What is claimed is:

1. An assembly comprising:

a carrier device having a low profile structure, the carrier device is configured to secure one or more slider bars to both a grinding-slicing machine and a lapping machine, wherein the carrier device comprises a plurality of bending strips extending from a connective portion at a proximal end of the carrier device to a bending tip proximate to a distal end of the carrier device, and wherein the bending strips and the connective portion form a base structure of the carrier device, thereby eliminating a need for an additional carrier base structure below the bending strips and enabling a thickness of the carrier device to be limited to about 2 to 3 millimeters, wherein the bending tip comprises a plurality of bending fingers; and a holder plate configured to secure the carrier device to the grinding-slicing machine, wherein the holder plate comprises a carrier portion and a clamp portion, wherein the carrier portion of the holder plate is configured to attach to the carrier device, and wherein the clamp portion is configured to attach to the grinding-slicing machine, and wherein the carrier portion of the holder plate comprises one or more holder fingers that correspond to the bending fingers of the carrier device.

2. The assembly of claim 1 and wherein the carrier portion of the holder plate comprises springs that are in contact with the holder fingers.

3. The assembly of claim 1 and wherein the holder plate comprises multiple thicknesses, and wherein the multiple thicknesses form at least one step.

4. The assembly of claim 3 and wherein the at least one step comprises a back edge surface that abuts the bending fingers of the carrier device when the carrier device is coupled to the holder plate.

5. An assembly comprising:

a carrier device configured to secure one or more slider bars to a lapping machine, the carrier device comprising:

a plurality of bending strips extending from a proximal end of the carrier device to a bending tip proximate to a distal end of the carrier device, wherein the bending tip comprises a plurality of bending fingers; and a holder plate configured to couple to the bending tip of the carrier device and configured to couple to a grinding-slicing machine, wherein the holder plate is configured to apply a displacement-limiting downward force on the plurality of bending strips and the plurality of bending fingers of the carrier device when the holder plate is coupled to the carrier device, and wherein the holder plate comprises springs that are positioned above the plurality of bending strips and the plurality of bending fingers of the carrier device when the holder plate is coupled to the carrier device, and wherein the springs are configured to apply the displacement-limiting downward force by contact with at least one of the plurality of bending strips or the plurality of bending fingers.

6. The assembly of claim 5 and wherein the holder plate comprises a plurality of holder fingers that correspond to the plurality of bending fingers of the carrier device.

7. The assembly of claim 5 and wherein each one of the plurality of bending fingers of the carrier device is u-shaped.

8. The assembly of claim 5 and wherein the holder plate comprises multiple thicknesses, wherein the multiple thicknesses form at least one step.

9. The assembly of claim 8 and wherein the at least one step comprises a back edge surface that abuts the plurality of bending fingers of the carrier device when the carrier device is coupled to the holder plate, thereby limiting movement of the plurality of bending fingers.

10. An assembly comprising:

a carrier device having proximal and distal ends, the carrier device comprises a workpiece platform, along the proximal end, configured to support one or more slider bars, wherein the carrier device is configured to attach to a lapping machine; and an adaptive component, comprising at least one spring, the adaptive component having a first portion configured to couple to the carrier device and a second portion configured to couple to a grinding-slicing machine, wherein the adaptive component is configured to apply a displacement-limiting downward force proximate to the distal end of the carrier device when the adaptive component is coupled to the carrier device, and wherein the at least one spring of the adaptive component is positioned above the carrier device when the adaptive component is coupled to the carrier device, and wherein the at least one spring is configured to apply the displacement-limiting downward force by contact with an upper surface of the carrier device proximate to the distal end of the carrier device.

11. The assembly of claim 10 and wherein the carrier device further comprises a plurality of bending strips extending from the proximal end of the carrier device to a bending tip proximate to the distal end of the carrier device, wherein the bending tip comprises a plurality of bending fingers.

12. The assembly of claim 11 and wherein the first portion of the adaptive component comprises a plurality of adaptive component fingers that correspond to the plurality of bending fingers of the carrier device.

13. The assembly of claim 12 and wherein the at least one spring is in the first portion of the adaptive component, and wherein the at least one spring is in contact with at least one of the plurality of adaptive component fingers.

14. The assembly of claim 10 and wherein the second portion of the adaptive component includes at least one feature that is configured to receive a clamping feature of the grinding-slicing machine.

* * * * *